United States Patent [19]

Godlewski

[11] Patent Number: 5,004,219

[45] Date of Patent: Apr. 2, 1991

[54] UP-FEED CONVEYOR SYSTEM

[76] Inventor: Edward S. Godlewski, 129 Spruce St., Wooddale, Ill. 60191

[21] Appl. No.: 325,572

[22] Filed: Mar. 20, 1989

Related U.S. Application Data

[63] Continuation of Ser. No. 7,125,923, Nov. 27, 1987.

[51] Int. Cl.[5] ..... B65H 3/06

[52] U.S. Cl. ..... 271/116; 271/117; 271/125; 271/149

[58] Field of Search ..... 271/31.1, 117, 121-125, 271/149-151, 162, 116

[56] References Cited

U.S. PATENT DOCUMENTS

| | | | |
|---|---|---|---|
| 1,912,941 | 6/1933 | Johnson | 271/149 |
| 2,762,623 | 9/1956 | Uthenwoldt | 271/116 |
| 3,070,368 | 12/1962 | Adams | 271/125 |
| 3,185,472 | 5/1965 | Rubow | 271/149 X |
| 3,598,399 | 8/1971 | Cottrell | 271/149 X |
| 3,982,749 | 9/1976 | Stobb | 271/117 X |
| 4,030,723 | 6/1977 | Irvine | 271/121 X |
| 4,158,456 | 6/1979 | Holland-Letz | 271/122 X |
| 4,177,982 | 12/1979 | Bewersdorf | 271/31.1 |
| 4,666,141 | 5/1987 | Labombarde | 271/151 X |
| 4,695,048 | 9/1987 | Gorner | 271/125 X |

*Primary Examiner*—Richard A. Schacher
*Attorney, Agent, or Firm*—John J. Kowalik

[57] ABSTRACT

A conveying system comprising an upfeed conveyor for conveying individual stock items upwardly to a press or the like and a generally horizontal infeed conveyor for conveying endwise a stack of items positioned on edge thereon to the upfeed conveyor which has several sections all of which are activated to move the item delivered thereto upwardly and wherein the lower sections are periodically stopped and the uppermost section is freely adapted to move to facilitate withdrawal of the item in transit from the upfeed conveyor, the infeed conveyor being vertically adjustable and tiltable with respect to the upfeed conveyor for handling different sized stock items, and wherein conveyors are so juxtaposed that the item in transit on the upfeed conveyor shields the upper portion of the next item from engaging movable section until the item in transit is completely withdrawn from the upfeed conveyor and wherein a retard is provided with an items gauge shield to insure single item feeding.

21 Claims, 8 Drawing Sheets

UP-FEED CONVEYOR SYSTEM

This application is a continuation of my U.S. application Ser. No. 07/125,923 filed Nov. 27, 1987 for up-feed conveyor system now abandoned.

BACKGROUND OF THE INVENTION

This invention appertains to conveyors for sequentially feeding individual stock items such as paper or envelopes into a press.

The invention comprehends a mechanism for delivering such items arranged in a stack and positioned on edge and leaned toward a series of conveying rollers of an upfeed conveyor with the item at the end of the stack bearing against all of the rollers. The items are then fed upwardly through a metering device into a horizontal delivery conveyor which feeds the item to the press.

DISCUSSION OF THE PRIOR ART

The common feeders either feed the stock items either from the top of a stack or the bottom. This presents many problems in the weight of the stack on the bottom item makes it difficult to extract the bottom item individually without pulling several overlaying items at the same time which results in multiple feeding or misfeeding.

Top feeding requires suction devices with attendant maintenance problems and cost of motor and pumps etc. as is well known.

SUMMARY OF THE INVENTION

This invention relates to an upfeed system of conveying stock items which are bunched or stacked on edge.

One object of the invention is to provide a novel feeder system comprising a first conveyor for feeding stock items positioned in a stack or bunch on edge and moving the stack with the first conveyor to a second conveyor positioned athwart the first conveyor against a series of diagonally upwardly arranged rollers of the second conveyor adapted to peel off from the adjacent end of the stack a single item from the remainder of the stack and delivering it to a metering device for delivery to a press.

The invention comprehends an upfeed conveyor in which a part thereof is inactivated while its delivery end is free moving to facilitate discharge of the end item from a stack pressed against the upfeed conveyor.

The invention contemplates a segmented upfeed conveyor and an arrangement of delivery of the stock items thereto sidewise so that the item being delivered obtains the full thrust of the entire conveyor upon initiation of delivery and then provides a segment at the delivery end of the upfeed conveyor which facilitates exit of that item.

An object of the invention is to provide an upfeed conveyor comprising a series of horizontal vertically spaced rollers in which each item is advanced sidewise toward the rollers and the rollers are arranged so that at least one exit roller at the upper end of the series is free rolling after being driven a partial revolution and the other rollers stop at every preset partial revolution so that the item in the delivery stage may complete its transit and exit while the next item is precluded from following, but must await the next complete cycle.

Another object of the invention is to provide a novel infeed conveyor which is adapted to feed a stack of items at a slope sidewise to an intersecting up feed conveyor and in which the infeed conveyor is adjustably mounted to locate between lower and upper positions for carrying larger and smaller items respectively and increase the angle of incidence to the plane of the upfeed conveyor when feeding smaller items to maintain a predetermined loading of the smaller and lighter items against the upfeed conveyor and to decrease the angle of incidence when feeding larger and heavier items to maintain substantially the same loading of the stack in all positions against the upfeed conveyor.

A corollary object is to provide a novel infeed conveyor mounting which upon raising and lowering the infeed conveyor it automatically changes its slope with respect to an upfeed conveyor.

A broad object of the invention is to provide a conveyor arrangement in which the end item of a stack is positioned on edge to lean against a series of rollers of an upfeed conveyor, the end item as it is being lifted sequentially exposing the rollers from bottom to top to the next item and while the end item exits from over the top roller, the end item shields the top roller from the next item unit it is pressed firmly against the other rollers which at that moment are stationary and then against the top roller which in the meantime has stopped.

A further object it to provide a novel self-tilting support for the stack conveyor, the support comprising a tray which is guided by a track at its discharge end and is guided by a pair of pendulously supported hangers or links intermediate its ends, the tray being carried by vertically adjustable links which lift or lower the tray and the conveyor carried thereby.

These and other objects and advantages inherent in and encompassed by the invention will become more apparent from the specification and the drawings, wherein.

DESCRIPTION OF THE INVENTION

Figure 1:
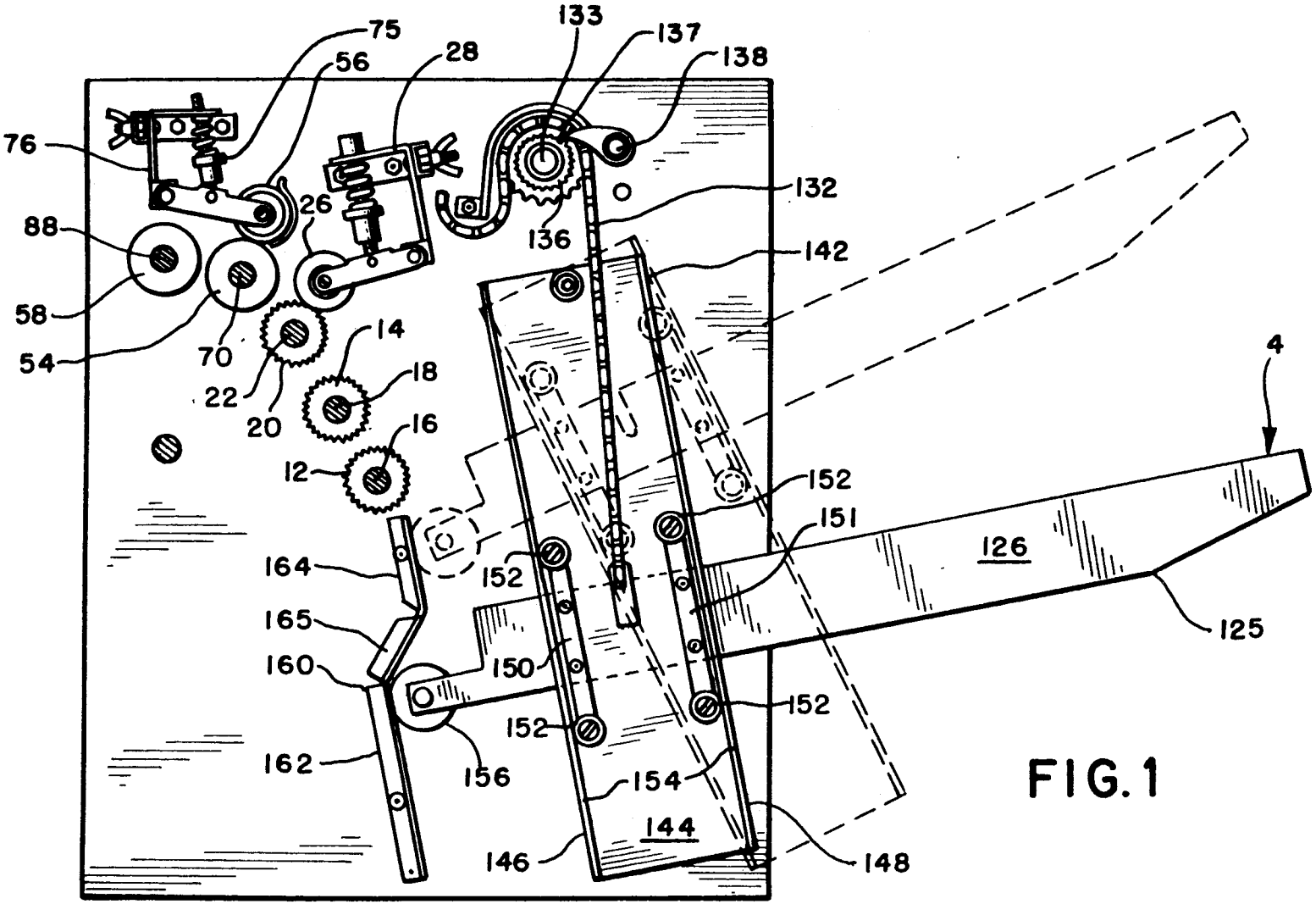
FIG. 1 is a vertical longitudinal sectional view of the device taken substantially on line 1—1 of FIG. 2.
Figure 2:
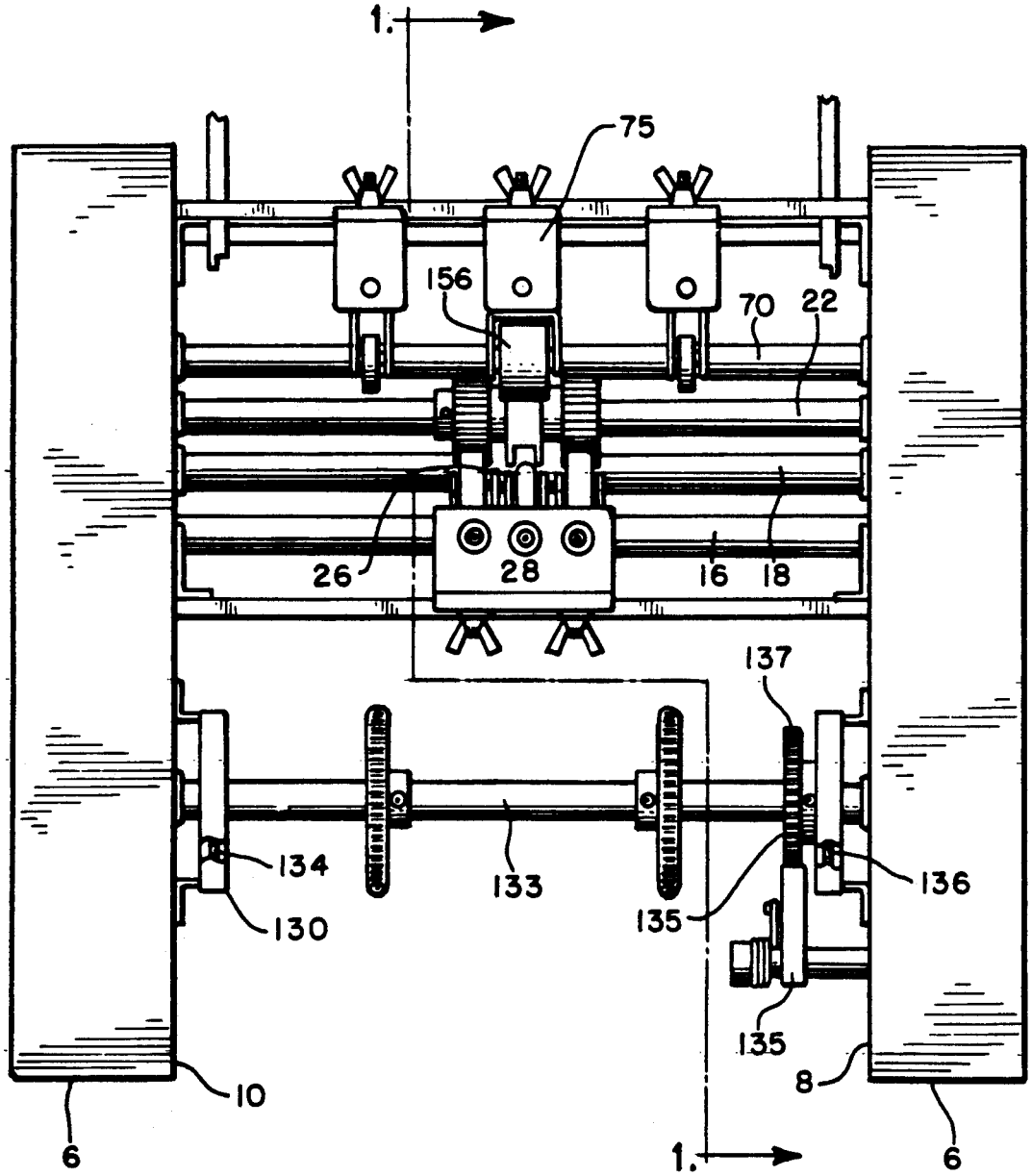
FIG. 2 is a top plan view of the device.
Figure 3:
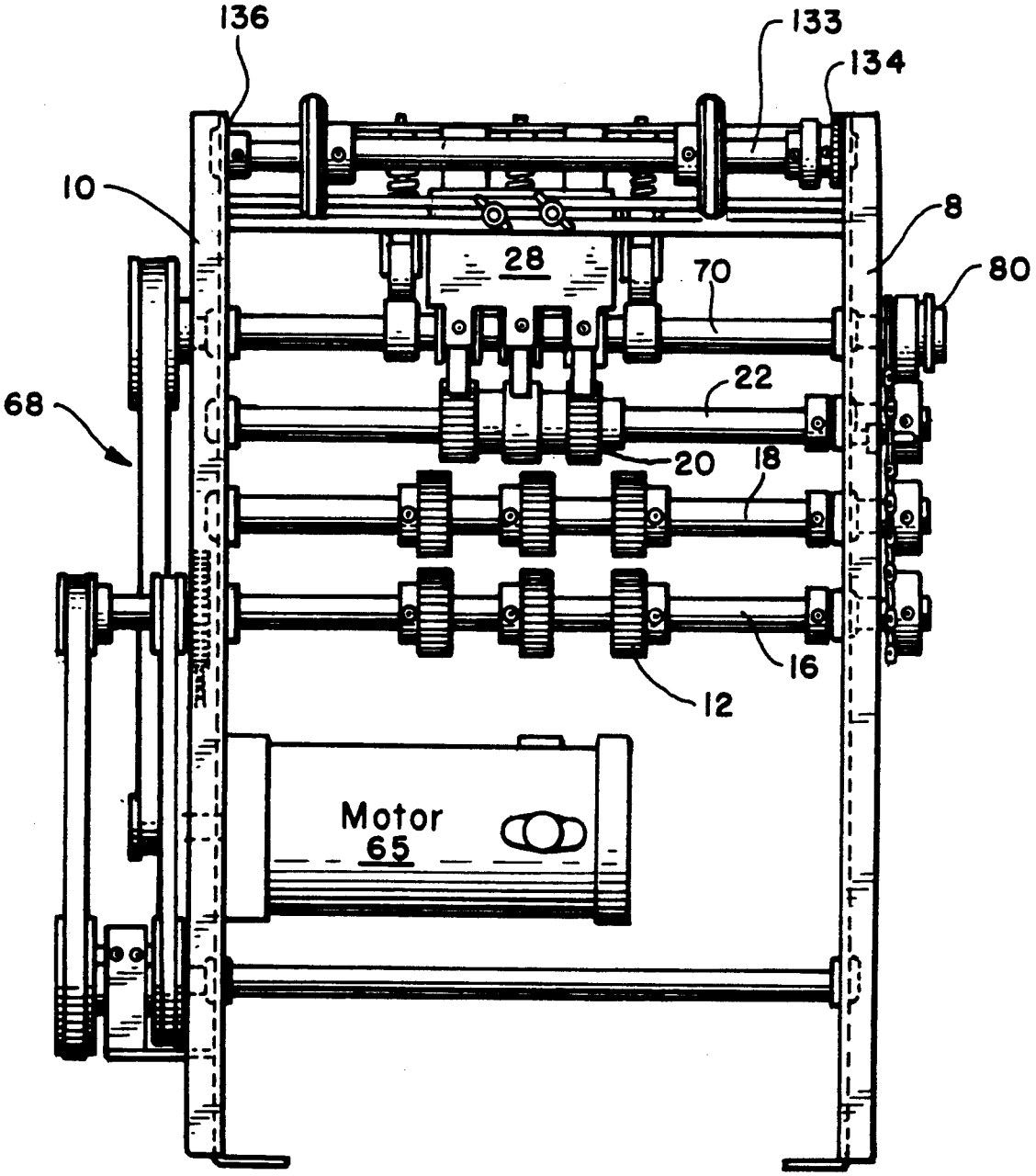
FIG. 3 is a bottom plan view.

The invention is disclosed with the associated drawings wherein the feeding mechanism generally indicated 1 comprises an upfeed conveyor 2 and an infeed conveyor 4 which extends laterally or transversely to the conveyor 2.

The feeder unit comprises a casing 6 which provides a support and has a pair of upright side walls 8 and 10.

The upfeed conveyor 2 comprises a series of three diagonally arranged horizontal, vertically spaced rollers. The bottom and intermediate rollers 12 and 14 are carried by horizontal transverse shafts 16, 18 journalled in bearings in the side walls 8 and 10 of the support and the uppermost or top roller 20 is carried on shaft 22 parallel with shafts 16 and 18 of bearings mounted on the side walls 8 and 10. The axes of the three rollers lie in a diagonal plane sloping downwardly toward the infeed conveyor.

Rollers 12 and 14 are interconnected by a sprocket and chain drive 24 which also rides on sprocket 25 mounted through a one way clutch to shaft 22. Thus upon rollers 12 and 14 being driven, the roller 20 is also driven. However, when the rollers 12 and 14 stop, the roller 20 continues to overrun its drive since the sprocket 25 is connected to shaft 22 by one way clutch 25.

The upper roller 20 cooperates with a stationary cylindrical or disk shaped retard 26 which is mounted on an adjuster 28 supported on a rail 30 which spans the space between the side walls 8 and 10 and is connected thereto.

Each retard disk is made of rubber or soft plastic or elastomeric material and is carried on one end of a vertically movable arm 32 secured to the center of the disk and pivoted at its other end as at 34 to a bracket which may form part of the rail 30 or be separate therefrom for lateral adjustment thereon. The arm 32 is biased downwardly by a spring 36 which has its lower end seated on a pressure adjusting nut 38 threaded on a bolt 40 which has its lower end pivotally connected at 42 to the arm 32 intermediate its ends. The upper end of the spring bears against the underside of a flange 44 of the bracket and the downward movement of the arm and retard is limited by the head 45 of the bolt 40 bottoming against the top of the bracket flange 44. The shank of the bolt passes through an appropriate aperture in the flange 44.

It will be noted that upon delivery of the end or first item 46 of the bunch or tack of items generally indicated 48 to the metering device, the item is grasped in the nip 50 between the retard and the upper roller and since the upper roller is being power rotated or driven with the intermediate and lower rollers, the item 46 will move upwardly through the nip and enters its leading end 52 into the nip of the upper and lower continuously driven feed rollers 54, 56 and be grasped thereby and fed into the horizontal delivery conveyor 58 which is periodically actuated by a suitable switch device on the press (not shown), as well known to those skilled in the art.

Thus as the item 46 is being withdrawn and the rollers 12 and 14 stopped the upper or exit roller 20 then free rolls. The trailing end of item 46 shields the next item from contact with roller 20 until the item 46 exits from the metering device whereupon roller 20 virtually stops and thereupon the upper end portion 60 of the next item drops against the roller 20 and is positioned to enter the metering nip 50.

The drive to the various components proceeds from an electric motor 65 having a connection with a suitable power source. The motor drives a belt and pulley assembly 68 which drives shaft 88 journalled in bearing in the side walls of the support parallel with the upfeed rollers and driving the conveyor 58 adjacent the discharge end of the upfeed conveyor. A pullout roller cooperates with the downwardly biased companion roller 56 mounted thereabove on a downwardly biased mounting structure 75 carried on a transverse rail 76 which spans the space between the sides of the support and is connected thereto.

Figure 8:
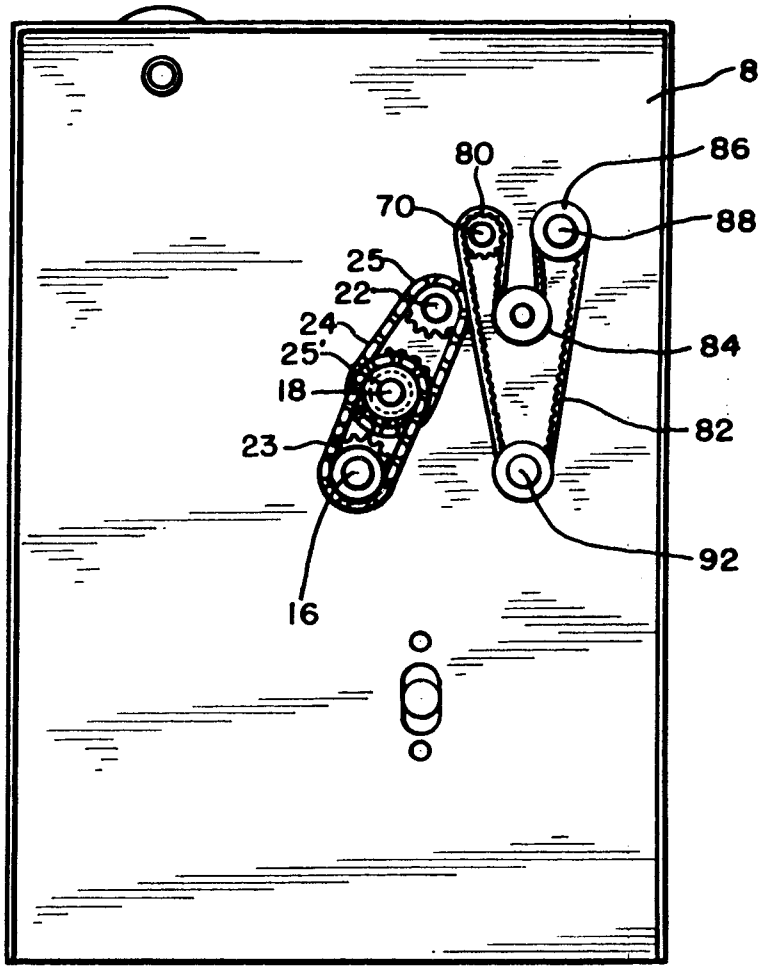
FIG. 8 is a side elevation of the opposite side of the unit and the drives to various components.

The shaft 88 is connected with pulley 86 (FIG. 8) which drives belt 82 wrapped about a tightener pully 84 and about pulley 80 which drives shaft 70 mounting the lower pullout roller 54 disposed to receive items from the metering device or retard assembly and convey the items to the delivery conveyor 58. The belt 82 drives a counter shaft 92 which is journalled in bearings in the side walls 8 and 10.

Figure 7:
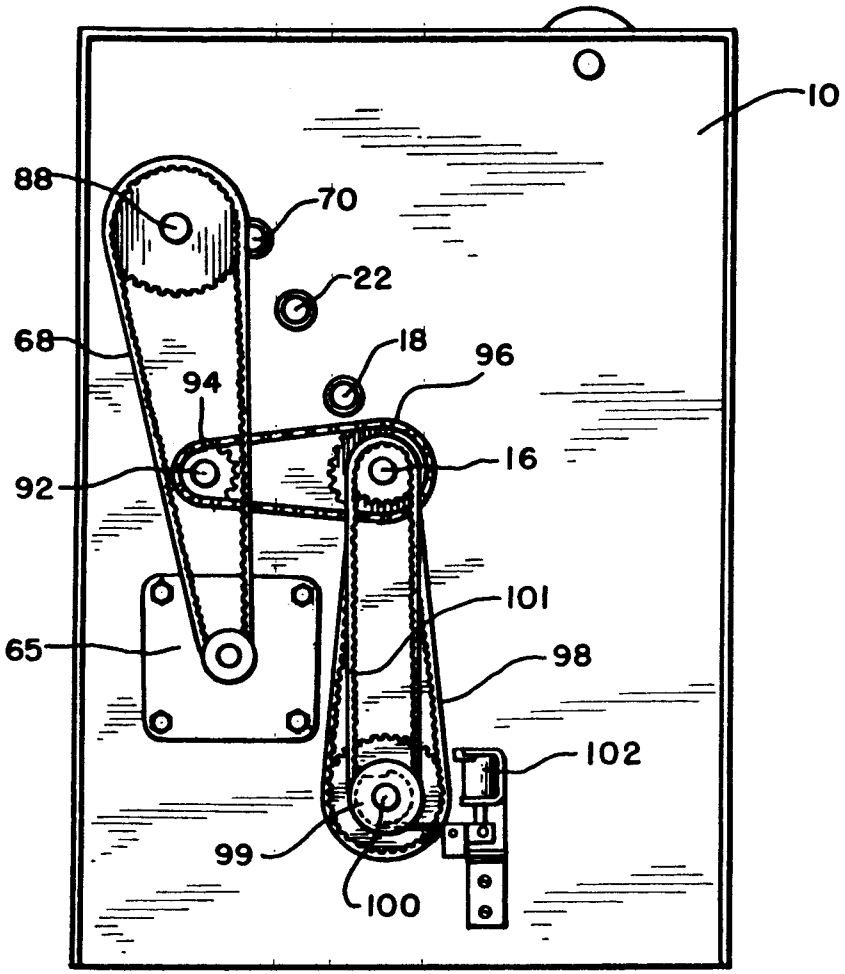
FIG. 7 is a side elevational view showing the drives at one side of the unit.

The countershaft 92 drives a sprocket 94 (FIG. 7) which drives a chain and sprocket drive 96 which in turn drives a belt and pulley assembly 98 connected by a one-way clutch 99 on shaft 100 and by drive 101 to shaft 16.

A solenoid operated clutch control 102 operates clutch 99 and is timed to clutch and declutch the drive to shafts 16, 18 and 22. The solenoid is connected in a circuit (not shown) to demand switch of the press. Each time the demand switch calls for an item clutch 99 is locked to drive shafts 16, 18 and 20 one half revolution and the rollers thereon. Sprocket 25 on shaft 18 is provided with a one way clutch 25' drives shaft 22 by a chain and sprocket drive 24 so that the discharge roller 20, upon termination of drive thereto is free to overrun and permits the item in transit which has entered the pullout roller to smoothly ride over roller 20 without resistant, while the intermediate and lower rollers, which have been stopped, engage the next item and thus frictionally resist its being lifted with the item in transit thereahead. Shafts 18 and 16 are interconnected by a sprocket and chain drive 23.

Figure 4:
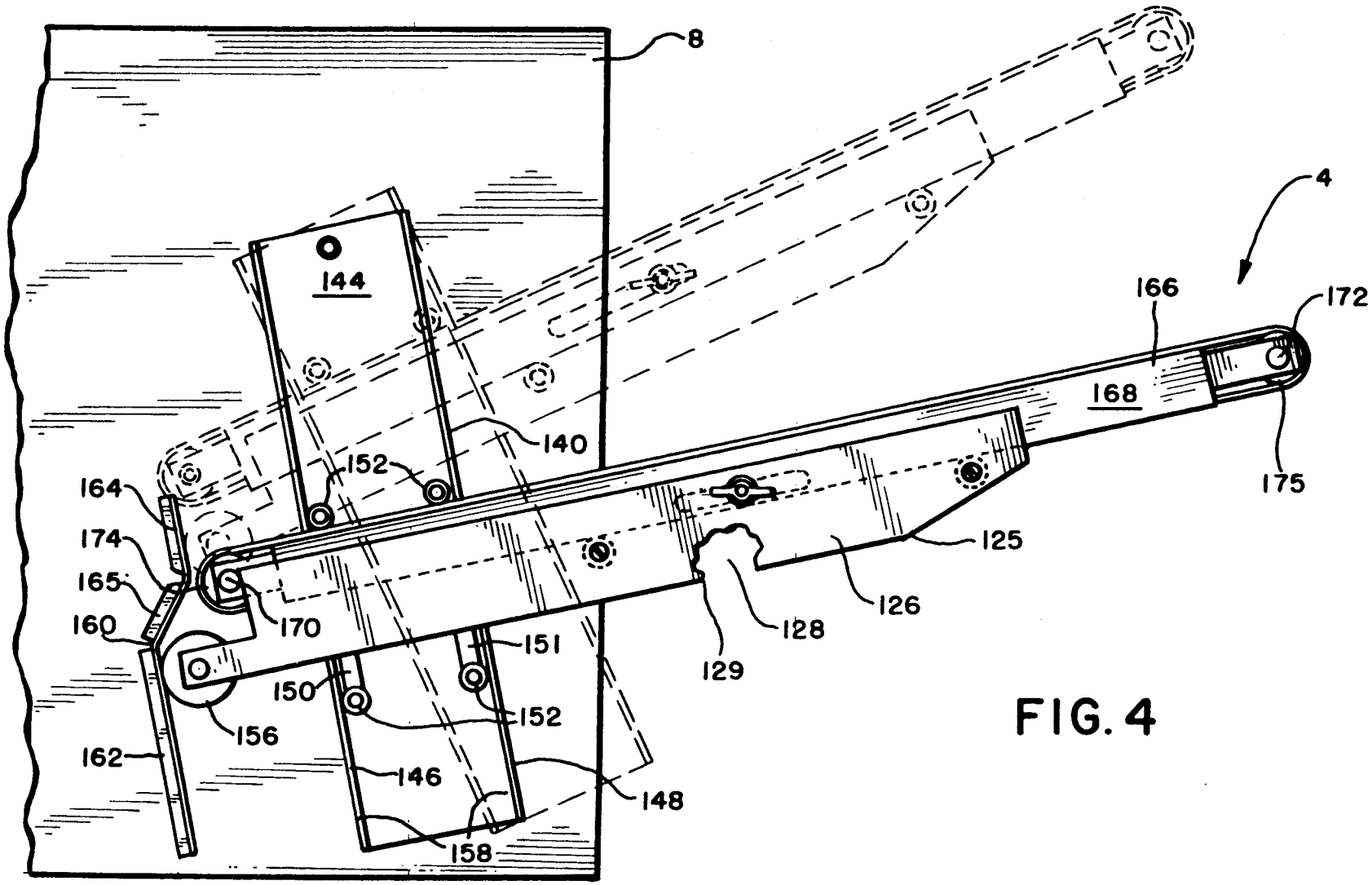
FIG. 4 is a longitudinal sectional view with parts shown in elevation and parts shown in adjusted elevated position in phantom lines.
Figure 5:
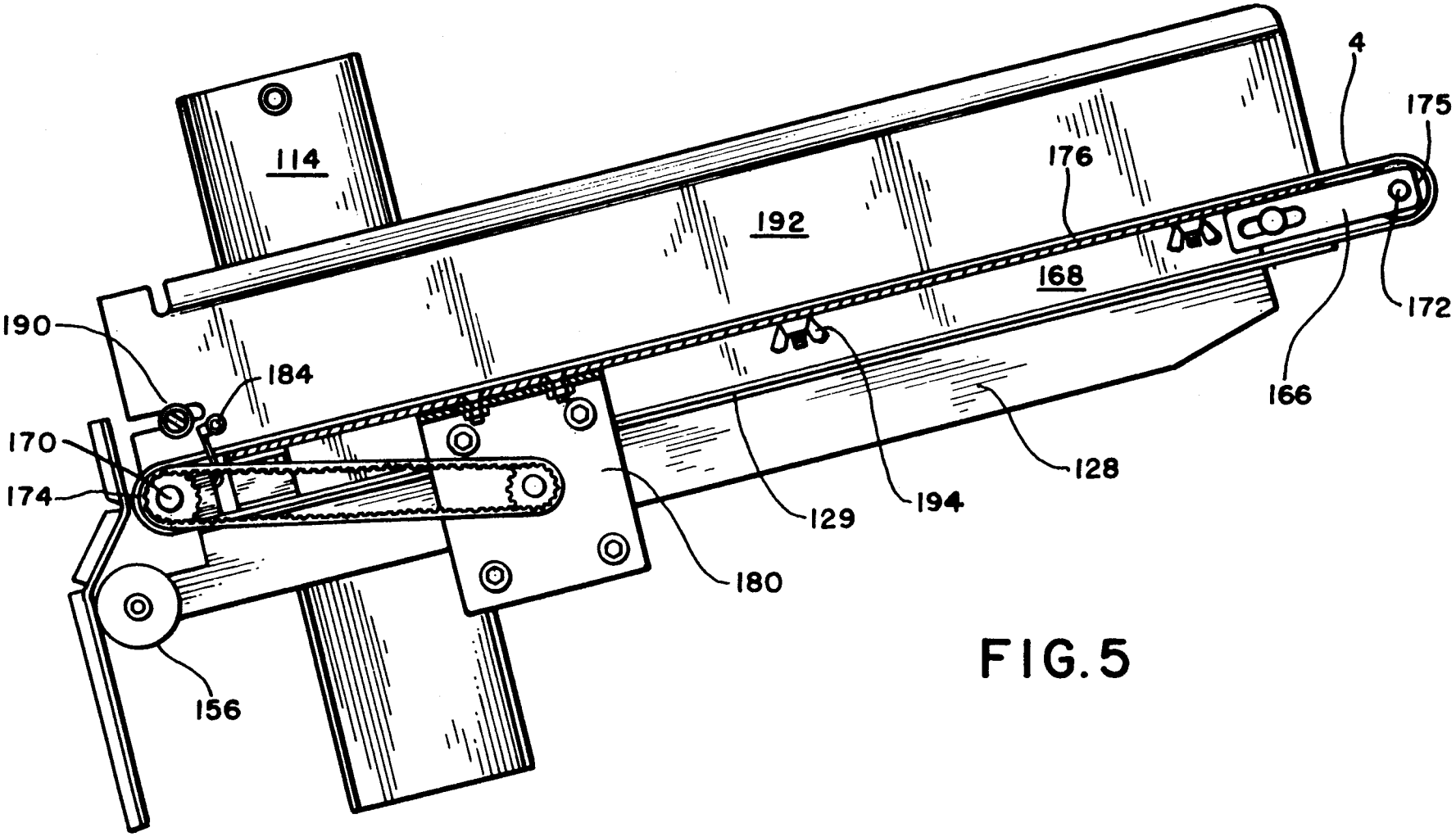
FIG. 5 is a longitudinal sectional view through the infeed conveyor in association with the support.
Figure 6:
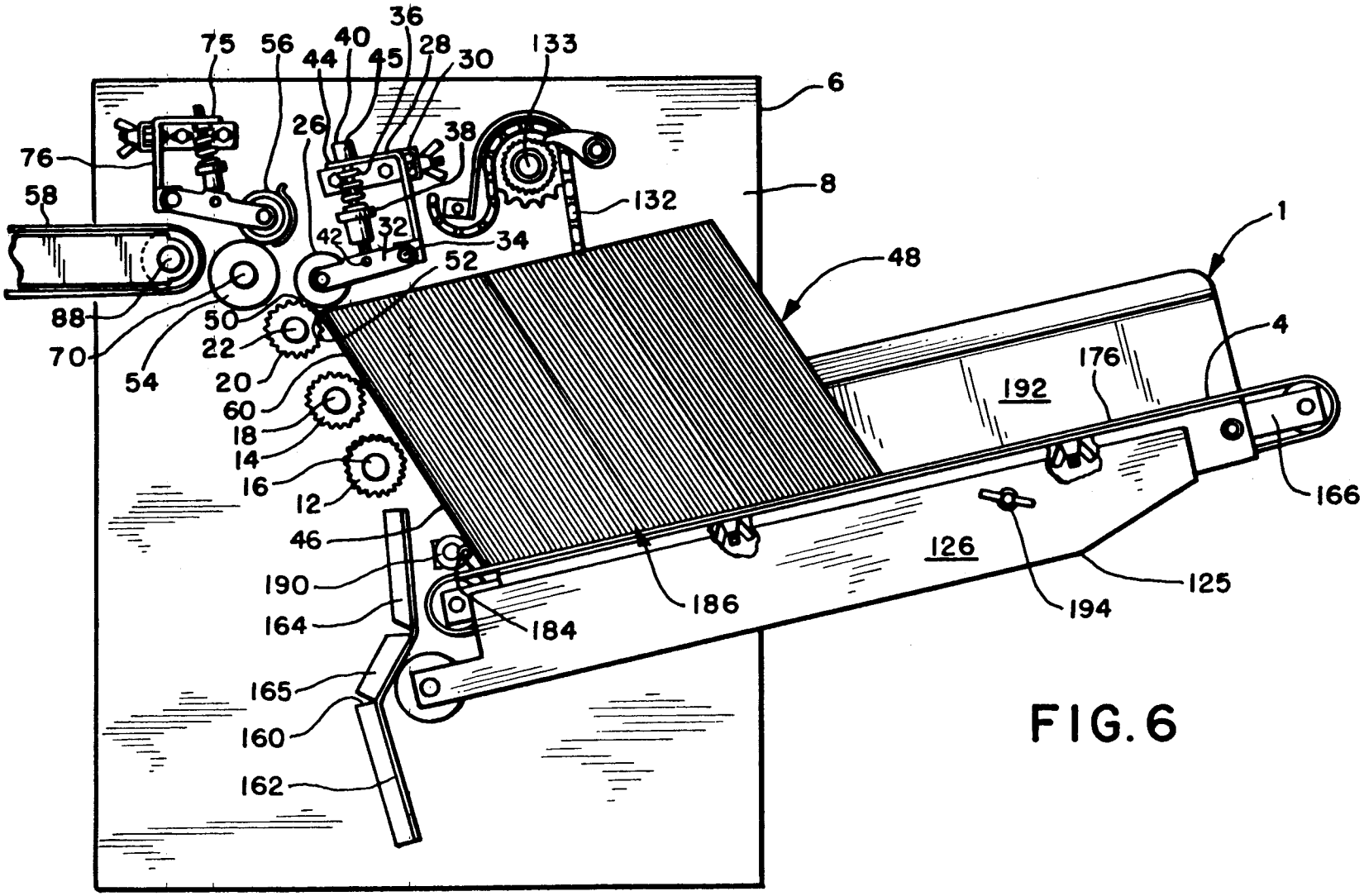
FIG. 6 is a view comparable to FIG. 4 but showing the infeed conveyor and the stack of times positioned on the infeed conveyor.

As best seen in FIGS. 1, 4, and 6 the infeed conveyor 4 comprises a tray or cradle 125 which has a pair of side walls 126, 128 and a bottom wall 129. The side walls 126, 128 are connected to lifting and lowering cables, chains or links 130, 132 which are draped at their upper ends over sprockets 134, 136 secured to a transverse shaft 133 of an adjusting mechanism 135. A ratchet 137 is secured at 138 to one of the side walls of the support.

A pair of pendular arms or links 140, 142 are pivoted coaxially at their upper ends from the side walls 8 and 10. Each arm is U-shaped in cross-section having a base wall 144 and a pair of flanges 146, 148 in parallel arrangement.

The tray has at each side thereof a pair of parallel upright guides or trolleys 150, 151 mounted on the side walls thereof as seen in FIG. 1 and the guides are provided on their upper and lower ends with rollers or wheels 152, 152 which ride along the interior sides 154, 154 of the flanges. Thus as the tray is lifted or lowered as the ratchet is engaged or disengaged the guide wheels 152 ride up and down within the respective arms and held in adjusted position by the ratchet.

The tray is provided on its forward end with a roller 156 adjacent to each side thereof rotatable on transverse axes along parallel coplanar or transversely aligned tracks 160 mounted on side walls 8 and 10. It will be noted that the position of the axis of pivot of hangers determines that the tray will be biased toward the tracks and that as seen in FIG. 1 the lower the tray is located the more horizontally it is positioned and the higher the more slanted. That is the angle of delivery from the tray to the upfeed conveyor is more acute than for the said items when the articles are small than when they are large. Thus the load exerted by the items both small and large against the upfeed conveyor is essentially the same.

For automatically tilting the tray to desired position, each track has a lower portion 162 offset inwardly with respect to its upper portion 164 and portions 162, 164 are connected at adjacent ends by a diagonal transition track section 165.

The tray mounts a conveyor 166 therein comprising a longitudinal frame 168 which at opposite ends mounts on parallel shafts 170, 172 pulleys 174, 175 mounting belts 176. The belts are driven from an electric motor 180 carried by the frame 168 by a belt and pulley drive to the shaft 170. The motor is suitably connected in a circuit through a switch 184 which is engaged by the end 46 of the stack when the conveyor is full or the supply is adequate. The stack is seated at one edge 186 on a carrier belt or belts 176. As the stack is depleted the switch 184 moves to an "on" position which completes the circuit though the motor 180 causing the motor to run and the belts to advance stock to the upfeed conveyor. When the stock engages the switch the motor is turned "off". The stock is shown in FIG. 6 and the lower end of the lower portion of an item is shown disengaging the switch. The stock engages adjacent to each lateral edge thereof with and abutment 190 mounted on and extending inwardly from each upright guide 192 flanking the stock. The guides 192 are adjustably mounted on the frame of the carrier or cradle and secured thereto by wing bolt and nut assemblies 194 to adjust for the width of the particular item being conveyed. It will be noted that the guides 192 are adjustable longitudinally and also laterally.

It will be apparent that the infeed conveyor may be easily disconnected or connected with the carrier or cradle and is adjustable toward away from the upfeed conveyor to move to the position shown in FIGS. 6 and 1 in particular.

Figure 10:
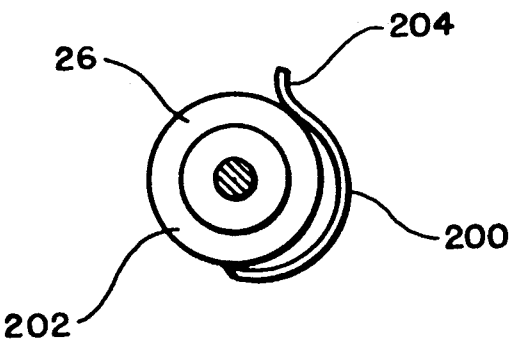
FIG. 10 is a fragmentary exploded view of a portion of the structure shown in FIG. 9.
Figure 9:
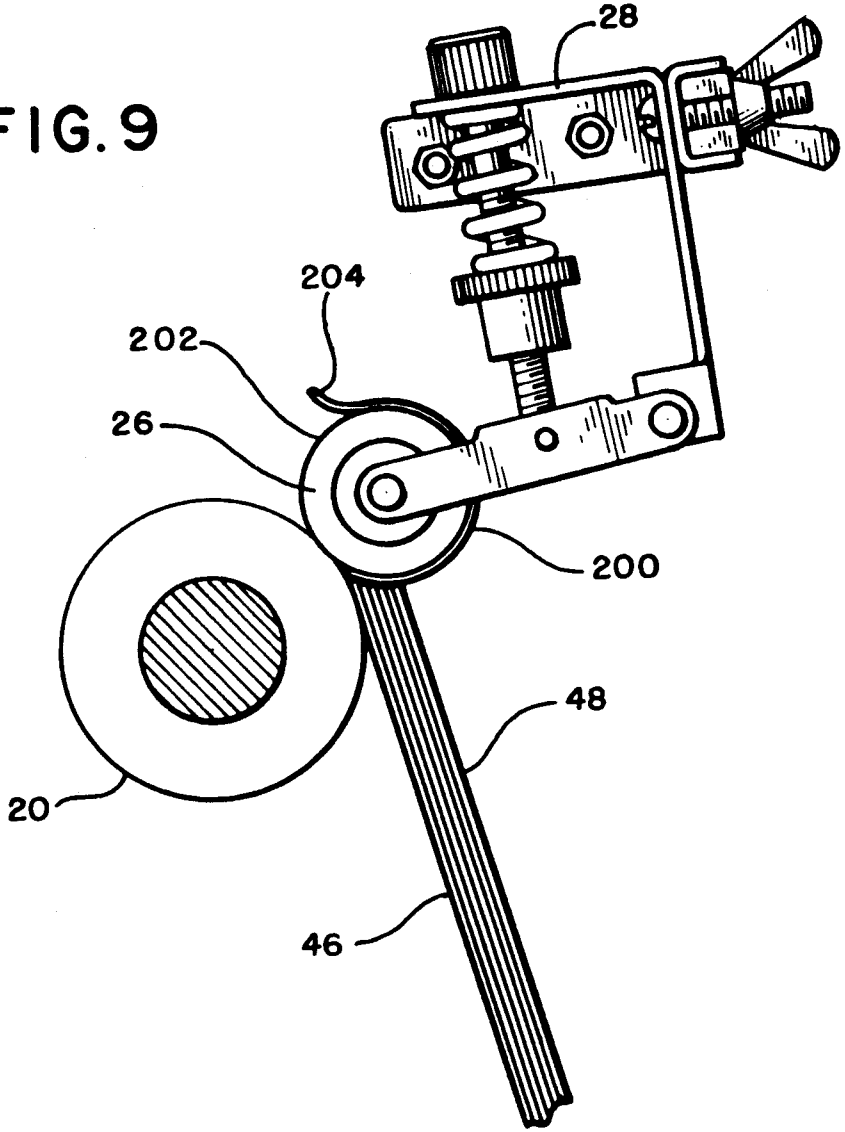
FIG. 9 is an enlarged side elevation of the retard.

To control and insure feeding single items through the retard 26, the retard is made of material having a high coefficient of friction. I have found that in this feeder the section of the retard presented to the items being fed must be limited. Otherwise the items engaging this prenip area will hang up and are resisted from entering the metering nip. In order to control the extent to the prenip area there is provided a shield 200 (FIGS. 9 and 10) in the form of an arcuate or C-shaped band wrapped about and embracing a major portion of the periphery 202 of the annular retard disk 26 and sphincterally embracing the same. A radially projecting finger nib 204 is provided at one end of the shield which permits rotation of the shield about the periphery of the disk 26 to regulate the retard area to approximately the thickness of one item as seen in FIG. 9 wherein the following items engage the underside or exterior 206 of the shield which is slick and permits succeeding items to readily slide one by one into the retard and thence into the retard nip. If the prenip area is too large experience has shown that the stock will not feed or will feed erratically.

Thus a novel and effective conveying system has been disclosed which is adapted to accommodate facile adjustment for items of various sizes, and also takes account that the infeed conveyor must be angled to the upfeed conveyor for different size items so as to obtain load vectors in the several positions to cause the items to bear adequately with substantially the same pressure against the upfeed conveyor. The spring steel or metal shield provides the necessary slippage for the stock to feed regularly into the metering nip.

I claim:

1. A conveyor system comprising a first conveyor and a second conveyor in feeding relation thereto for feeding stock items positioned on edge in a stack upon said second conveyor and delivering said items sidewise to the first conveyor, said first conveyor comprising a series of sets of rollers said sets being mounted on parallel axes spaced longitudinally of said first conveyor in engagement with the item at the adjacent end of the stack and operative to slough off the end item from the stack and deliver the same to associated pull-out mechanism, said items having leading and trailing end portions, and said rollers comprising means for non-rotationally frictionally engaging and trailing end portion of each successive item as the end item thereahead is being discharged by the first conveyor and thereby exposing the trailing end portion of the next item for engagement with said means to restrain and prevent the end item from dragging the next item to discharge therewith.

2. A system according to claim 1, and said first conveyor having a delivery end discharging items therefrom, and metering means at said discharge end defined with a roller there adjacent for intercepting the items being discharged from said discharge end.

3. The invention according to claim 2, and pullout rollers in receiving relation to items issuing from said metering means for delivery to an associated press, and gauge means associated with said metering means for adjusting said metering means for items of different thickness.

4. The invention according to claim 1, said sets of rollers comprising an endmost set, and means for driving the endmost set of said rollers and the other of said rollers for a predetermined period of time and then stopping the drive thereto thereafter attendant the end most item being pulled by said pull-out mechanism, and said endmost set of rollers having drive means accommodating overrunning thereof attendant to termination of drive thereto to permit unrestricted exit of the item then being discharged from the first conveyor to said mechanism.

5. The invention according to claim 1, and said second conveyor being disposed generally horizontally, and means for adjusting the second conveyor at selected inclinations with respect to the first conveyor to accommodate deposit of various sized items onto said first conveyor.

6. The invention according to claim 5, and said adjusting means comprising means for tilting the second conveyor with respect to the first conveyor compatible with the feeding characteristics of the items in the stack.

7. The invention according to claim 6, and means for adjusting said second conveyor upwardly and downwardly and inwardly and outwardly with respect to said first conveyor.

8. A conveying system comprising a frame, an individual item upfeed conveyor mounted on the frame and an infeed conveyor on the frame having a delivery surface for feeding a stack of items positioned on edge thereon sidewise against said upfeed conveyor, and means for adjustably mounting said infeed conveyor with respect to said upfeed conveyor at selected inclined angular positions of said delivery surface to the plane of delivery of said items by said upfeed conveyor and means for translocating said infeed conveyor along the length of said upfeed conveyor for different sized items.

9. The invention according to claim 8, and said adjustable means comprising pendulous means for guiding said infeed conveyor vertically and swingable toward and away from said upfeed conveyor.

10. The invention according to claim 9 and said adjustable means comprising track means on the frame engageable with said infeed conveyor for moving the same toward and away from said infeed conveyor in accordance with its adjusted vertical disposition.

11. The invention according to claim 8 and, said mounting means comprising a pair of arms pendulously suspended from said frame and flanking said infeed conveyor, and said infeed conveyor having vertically slidable means interlocked with said arms, and means for incrementally lifting and lowering said infeed conveyor and supported from the frame.

12. A conveying system comprising a frame, an individual item upfeed conveyor mounted on the frame and an infeed conveyor on the frame having a delivery surface for feeding a stack of items positioned on edge thereon sidewise against said upfeed conveyor, and means for adjustably mounting said infeed conveyor with respect to said upfeed conveyor at selected angular positions of said delivery surface to the plane of delivery of said items by said upfeed conveyor for different sized items, and said mounting means comprising a pair of arms pendulously suspended from the frame and flanking said infeed conveyor, and said infeed conveyor having vertically slidable means interlocked with said arms, and means for incrementally lifting and lowering said infeed conveyor and supported from the frame, and said adjusting means comprising guide means on the frame including upper and lower sections positioned at opposite sides of the upfeed conveyor, and rotatable means on said infeed conveyor engageable with said upper sections in the elevated position of said infeed conveyor and with the lower sections in the lowered position of said infeed conveyor.

13. The invention according to claim 12 and said infeed conveyor comprising a tray carried by said mounting means and a self-contained conveyor within the tray adjustable toward and away with respect to said upfeed conveyor.

14. A conveyor system for delivery of stacked items to a press comprising an upright upfeed conveyor for upward delivery of individual stock items, and an infeed conveyor positioned transversely of the upfeed conveyor for supporting a stack of items on one of their edges and moving the stack endwise toward the upfeed conveyor and for engaging an end item of said stack with said upfeed conveyor, press-actuated means for periodically actuating said upfeed conveyor for removing the end item from the stack and delivering it to the press and exposing the next item, and means for engaging part of the said next item being exposed behind the end item being carried by the upfeed conveyor for resisting discharge of both items simultaneously and said engaging means being movable and operable to assist removal of the end items and then operable to engage said next item and temporarily resist its discharge.

15. The invention according to claim 14, and said upfeed conveyor being positioned athwart said infeed conveyor and means adjustably mounting said infeed conveyor including means for inclining it at selected angles to said upfeed conveyor.

16. The invention according to claim 15, and said mounting means comprising means for pendulously mounting said infeed conveyor, and said means for inclining including means for translocatingly guiding the infeed conveyor vertically and comprising track means for tilting said infeed conveyor while it swings on said pendulous mounting means.

17. The invention according to claim 14, and said infeed conveyor comprising stop means at its delivery end for engagement with lower portions of said items as they are moved toward the upfeed conveyor causing said items to lean against said upfeed conveyor at various inclinations for initially engaging only the upper roller assembly and at certain other inclinations also engaging an intermediate roller assembly.

18. The invention according to claim 14, and said infeed conveyor having means for holding said stock in said leaning position for reducing the load of said stock against the upfeed conveyor for thereby facilitating removal of the end item by the upfeed conveyor from said stack.

19. A conveyor system for delivery of stacked items to a press comprising an upright upfeed conveyor for upward delivery of individual stock items, and an infeed conveyor positioned transversely of the upfeed conveyor for supporting a stack of items on one of their edges and moving the stack endwise toward the upfeed conveyor and for engaging an end item of said stack with said upfeed conveyor, press-actuated means for periodically actuating said upfeed conveyor for removing the end item from the stack and delivering it to the press and exposing the next item, and means for engaging part of the said next item being exposed behind the end item being carried by the upfeed conveyor for resisting discharge of both items simultaneously, and said upfeed conveyor comprising a top roller assembly and intermediate and bottom roller assemblies, and said actuating means driving all of said roller assemblies during an initial predetermined period and thereafter stopping said intermediate and bottom roller assemblies, and overrunning clutch means connecting said top roller assembly to said actuating means for accommodating rotation of the top rollers assembly to permit, after the intermediate and bottom roller assemblies have stopped, complete removal of the item being removed after the actuation period, and said engaging means comprising said stopped intermediate and bottom roller assemblies.

20. The invention according to claim 19, and metering means associated with the top roller assembly and comprising a retard member cooperatively associated therewith.

21. In a conveying system having a retard member mounted on a horizontal axis for metering individual items from a stack having edges sweeping along the retard, means including the retard member providing a metering nip for withdrawing the items individually from one end of a stack, said retard member having an area presenting a high coefficient of friction adjacent the nip, and means mounted on the retard for shielding a selected portion of said area adjacent said nip and providing a low frictional external slide surface for engagement by the edges of successive individual items entering the nip to eliminate hangups of the successive individual items on the retard member and thus inhibiting said items from evenly entering the nip, said shielding means comprising a strip of material extending about said axis and holding said retard member with a sphincteral grip and swingable about said axis to position said shield in selected positions exposing different portions of said area.

* * * * *